United States Patent [19]

Fukuyama

[11] 3,952,673

[45] Apr. 27, 1976

[54] AUTOMATIC METHOD AND APPARATUS FOR CLOSING THE TOE OF SEAMLESS HOSE

[75] Inventor: Yoshinobu Fukuyama, Kashiwara, Japan

[73] Assignee: Takatori Machinery Works, Ltd., Yamatotakada, Japan

[22] Filed: Apr. 14, 1975

[21] Appl. No.: 567,822

Related U.S. Application Data

[62] Division of Ser. No. 477,824, June 10, 1974.

[30] Foreign Application Priority Data

Dec. 28, 1973 Japan ..... 49-3466

[52] U.S. Cl. ..... 112/121.15

[51] Int. Cl.[2] ..... D05B 19/00; D05B 21/00

[58] Field of Search ..... 112/121.15, 121.12, 112/121.11, 121.29, 25, 26, 27, 262; 223/112

[56] References Cited

UNITED STATES PATENTS

| | | | |
|---|---|---|---|
| 3,486,471 | 12/1969 | De Spain | 112/121.15 |
| 3,859,938 | 1/1975 | Fukuyama | 112/121.15 |
| 3,875,880 | 4/1975 | Hazelgrove et al. | 112/121.15 |

*Primary Examiner*—Werner H. Schroeder
*Assistant Examiner*—Peter Nerbun
*Attorney, Agent, or Firm*—Kenyon & Kenyon

[57] ABSTRACT

Method and apparatus for automatically carrying out a toe-closing operation for a plurality of seamless hose simultaneously by several successive operational steps. One cycle of the successive steps being carried out during one cycle of the travelling of said hose along an endless passage. The steps are: sucking the toe portion of the hose into a suction tube, holding the welt portion inside out on finger pieces, clamping the toe portion of the hose by the clamp of the sewing machine after the toe closing operation has been enlarged laterally and moved forwardly, and sucking the toe closed hose into the suction tube by the suction force in the suction tube.

9 Claims, 24 Drawing Figures

10
20
67
58
57
59
56
54
55
II
C2
D1
I
(C1)
IV 10
46
54
20
67
65

AUTOMATIC METHOD AND APPARATUS FOR CLOSING THE TOE OF SEAMLESS HOSE

This is a division of application Ser. No. 477,824, filed June 10, 1974.

The present invention relates to an automatic method and apparatus for uniting seamless knitted hose so as to form the toe thereof and, more particularly, relates to an automatic method and apparatus for carrying out the toe-closing operation on a plurality of seamless knitted hose simultaneously by several successive operational steps which are carried out during one cycle of the travelling of said hose along an endless passage.

It is well known that several automatic apparatus for closing the material at the toe of seamless hose have been proposed for practical use in the hosiery industry. In some of these automatic apparatuses a suction pulse of short duration is applied in a pneumatic system whereby the hose is sucked into a suction tube, toe end first, while an operator holds the welt end portion of the hose. When the hose has been sucked into the tube, he draws the hose onto the tube whereby it is turned inside out. Then the operator pulls the toe end forward and slides a short toe end portion of the hose onto a pair of flat fingers and said short toe end portion is positioned at a predetermined position on the fingers. Next, the toe portion is transferred from the fingers to a clamping device of a sewing mechanism for the toe-closing operation. After completion of the toe-closing operation, the hose is sucked into the tube with the closed toe end portion first so that the hose is reversed to its normal condition, with its outside facing out, and carried away by a suction air current to a successive working station.

The conventional toe-closing operation must include a cycle of operations having three individual steps for each stocking comprising: preparation for transferring the toe end portion of a hose to the clamping device of the sewing mechanism; toe-closing by the sewing mechanism and; carrying the completed stocking to the successive working station by utilizing a pneumatic conveyor.

One example of the conventional apparatus is the device as disclosed in the U.K. Pat. No. 1,039,104. This apparatus comprises only one carrier in the form of an inspection leg member mounted on a frame and driven in a reciprocating movement by drive means in a housing, clamp means mounted on said frame and driven in a restricted rotary movement by drive means in a housing, and the toe-closing means in the form of cutting and sewing machines. In this device, it is necessary for the operator to manually turn the hose inside out and then draw the hose over the leg. This means that some of the operational steps are assigned to the operator, since the apparatus is incapable of performing them. Furthermore, as there is provided only one carrier for this apparatus, only one hose can be toe-closed during one cycle of the operation of this apparatus. Hence, this apparatus is not a high production machine.

Another apparatus is disclosed in the U.S. Pat. No. 3,738,294. This apparatus comprises three smooth parallel tubes extending through a rotating disc, a pad of foam plastic which is engageable with the outer surface of any one of the tubes and is movable in the longitudinal direction of the tube, a transfer member and a sewing machine provided with a presser foot and a table surface. In this apparatus, the operator holds onto the welt end of the hose which is then sucked into the tube, and then he draws the hose onto the tube manually so that it is turned inside out. The operator also manually pulls the toe-end forward and slides a short toe end portion of the hose onto two flat fingers of the transfer member. The third step consists of sucking the hose into the tube, toe end first, and carrying the hose away by the suction air current, after the closed hose is slide backwards on the tube by means of the backward movement of the pag along the tube. Obviously, several manual operations are necessary within one cycle of this automatic toe-closing operation.

A further means is disclosed in U.S. Pat. No. 3,420,196. This means comprises a conveyor means and a plurality of turning forms which are carried by said conveyor means, so that each of said turning forms carrying the hose can move from the receiving station A to the removal station C via a toe-closing station B. In this means, there is no such concept that the toe portion of a hose is transferred from a carrying form to the clamping device of a sewing machine. Therefore this means that when the toe is closed with circular configuration it is convenient to hold the hose projected beyong the turning form as in the case of U.S. Pat. No. 3,738,294, because such hose may be moved and twisted without any resistance during the toe-closing, although this feature is not present in the present invention.

The principal object of the present invention is to eliminate the above-mentioned manual operations, that is, to provide a method and apparatus for carrying out the automatic toe-closing operation with a minimum of labor.

To attain the above-mentioned object, in the method for carrying out the toe-closing operation according to the present invention, a conventional stationary automatic sewing machine is used, while a novel method is employed for transferring the toe end portion of each hose to the mechanism of said stationary sewing machine. Namely, in the apparatus of the present invention, all of the hose holding units, which are arranged parallel and horizontal, move along an oval endless passage. Said holding units travel along one section of said endless passage at a low speed, and then along the following section of said endless passage at a high speed, but when they reach the toe-closing position they remain stationary during the period of the toe-closing operation.

A definite advantage resides in the fact that the parallel and horizontal arrangement of the holding units is very suitable for the handling of the hose by operator during the arrangement of the seamless hose on the suction pipe and the turning of the welt portion of said hose inside out. The advantage of the parallel and horizontal arrangement of the holding units in the present invention, is that the operator need only move his left hand short distance from his side and use his right hand only to pick up new hose to be toe-closed. This means the hand motions of the operator are very simple and that there is no necessity him to step away from his position. Therefore by utilizing the mechanism of the present invention, the toe-closing operation can be very satisfactorily carried out.

For the sake of better understanding, the one-cycle operation of the toe-closing according to the present invention is hereinafter briefly illustrated.

1. The first step.

a. Sub-step A:

An operator picks up a welt portion of a seamless knitted hose, which is used for making a stocking, and holds its toe end in front of a suction tube so as to let the toe end of the hose be sucked into the suction tube. Then the hose is sucked into the suction tube, toe end first, while the operator holds the welt end portion of the hose.

b. Sub-step B:

When the hose has been sucked into the tube, the above-mentioned suction is stopped. The welt portion is then manually turned inside-out and drawn over the outside of the suction tube so as to cover the suction tube (this position is hereinafter referred to as a rest position), and next the hose is automatically further drawn onto the outside of the tube by mechanical drawing-on means, whereby the hose is turned inside-out. In this turn-out operation, the toe end portion of the hose is brought outside of but not onto the suction tube.

c. Sub-step C:

A pair of finger pieces are provided which are capable of sliding along the suction tube in such a way that the finger pieces are retracted into a member rigidly supported by the suction tube when it is required, are capable of spreading laterally when required, and are also capable of projecting from said member along a path corresponding to an extension of the longitudinal axis of the suction tube. This latter action causes the toe end portion of the hose to be displaced toward a clamping member of a sewing mechanism while the toe end portion of the hose is gradually spread out laterally in accordance with the above-mentioned motions of the finger pieces.

2. The second step.

a. Sub-step D:

The toe end portion of the hose carried by the motion of the finger pieces is transferred to the clamping member of the sewing mechanism and is gripped by it without changing the above-mentioned laterally spread out condition thereof. During the above-mentioned operation, the welt portion of the hose is positioned at its rest position, and the toe portion is gripped by the clamping member of the sewing machine in a laterally spread out flat condition.

b. Sub-step E:

The sewing machine is actuated so that the toe-closing operation is carried out.

3. The third step.

a. Sub-step F:

After completion of the toe-closing operation, the grip by the clamping member is released so that the toe end portion of the hose is released from the grip member. Next, the hose is automatically drawn onto the outside of suction tube by means of a drawing-on mechanism.

b. Sub-step G:

The pneumatic system is actuated to apply a suction force to the suction tube so that the closed toe end portion is firstly sucked into the tube, while the hose drawn on the outside of the suction tube is positively withdrawn from there by means of a drawing off mechanism. According to this operation, the hose is completely drawn off from the outside of the suction tube and then, the hose is sucked into the suction tube and carried to the successive working station by the above-mentioned suction force.

The above-mentioned steps of the one-cycle operation are applied to each one of a plurality of hose which are simultaneously subjected to a toe-closing operation at a predetermined time interval.

To attain the above-mentioned stepwise toe-closing operation, in an automatic toe-closing machine according to the present invention, a plurality of holding units are provided to carry out the above-mentioned plurality of sub steps of the toe-closing operation. The holding unit comprises a holding member consisting of a suction tube with support members, and a pair of finger pieces capable of sliding along the longitudinal axis of the suction tube in such a way that the finger pieces are retracted into the support member when it is required or projected beyond a free forward end of the support member when it is necessary to carry a toe end portion of the hose toward the clamping member of the sewing mechanism. A supporting member consists of a pair of brackets holding the suction tube and a stay rod.

All of the holding units of the present invention are so arranged that they are parallel to each other and travel along the endless passage maintaining their horizontal relation. During the travels of one of said holding units said holding unit travels along one section of a half circle configuration of the endless passage at a low but constant speed, and along the following straight section at a high speed, which is double the lower speed. After reaching said toe-closing position, the holding member rests there, until the toe-closing operation is completely carried out. When this is accomplished, it travels at a higher speed until it reaches the position where step G above can be carried out.

The various features and advantages of the present invention are contained in the preferred embodiment described in detail below and illustrated in the accompanying drawings, in which.

Figure 1:
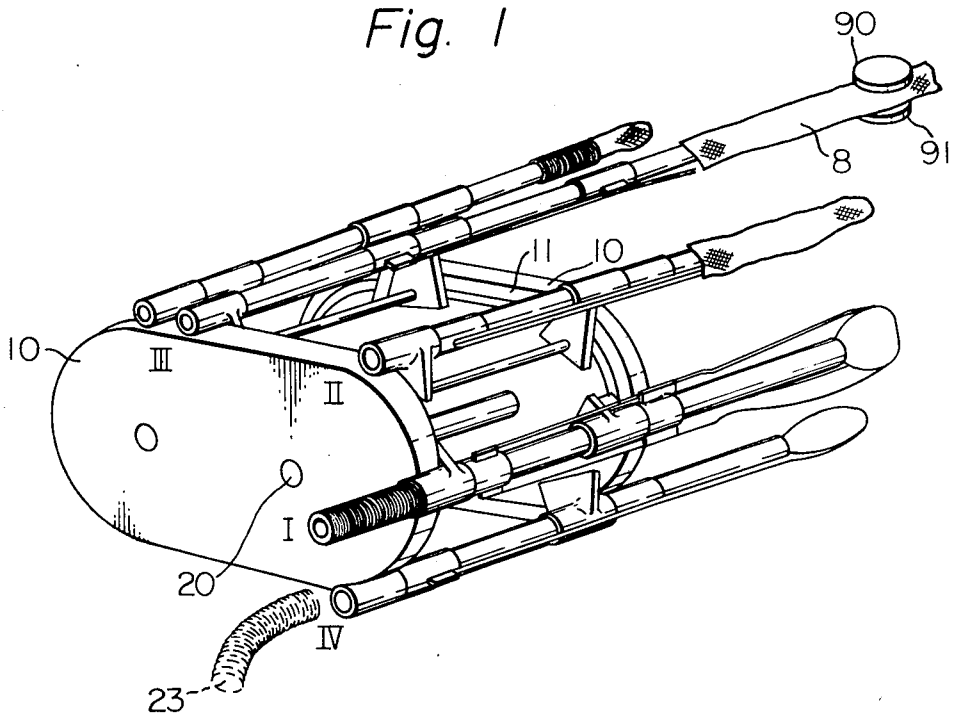
FIG. 1 is a perspective view of the general arrangement of the present invention.
Figure 3:
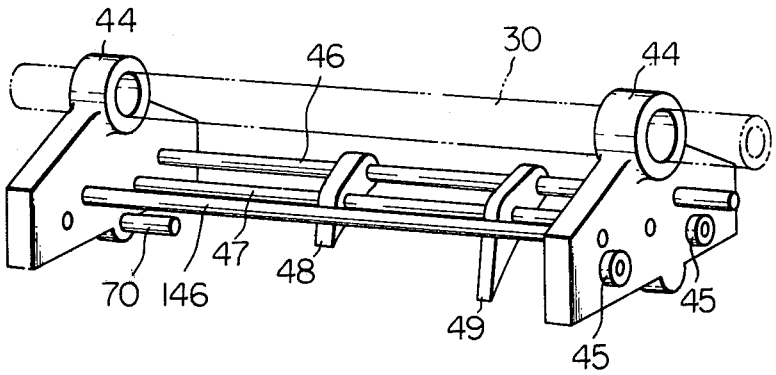
FIG. 3 is a perspective view of a supporting part for a holding member.
Figure 9:
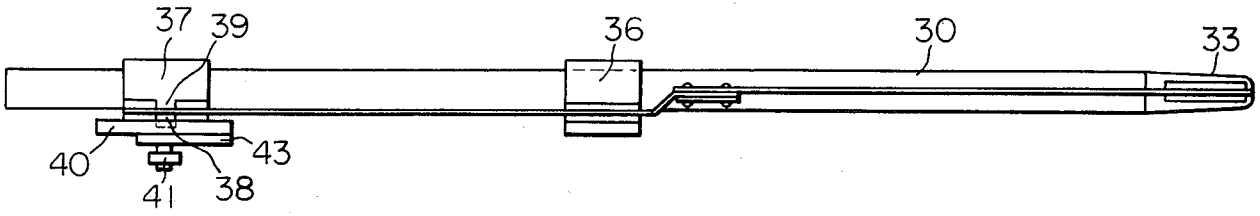
FIG. 9 is a side view of the holding member.
Figure 10:
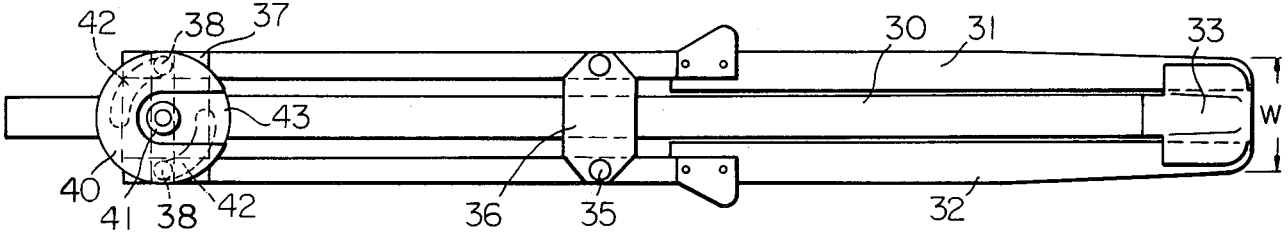
FIG. 10 is a plane view of the holding member when a pair of finger pieces are located in their normal positions on a holding member.
Figure 11:
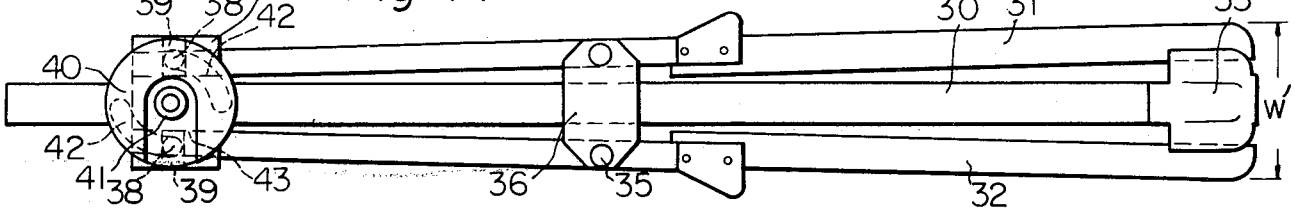
FIG. 11 is a similar plane view to that of FIG. 10, except that the pair of finger pieces are spread out.

As shown in FIG. 1, the present toe-closer is provided with a pair of side frames 10. On each of said frames an endless guide groove 11 with an oval configuration is provided, and these guide grooves 11 are so arranged that they face each other. As shown in FIGS. 9 through 11, the holding member consists of a suction tube 30, a pair of finger pieces 31, 32 and also front and back brackets 44 (see FIG. 3) fixed on said suction tube. On the outer side of each of bracket 44, as shown in FIG. 3, two rollers 45 are rotatably mounted, and between the two brackets 44 a stay rod 46 is mounted. When the rollers on the bracket 44 are mounted in the endless guide grooves 11, the holding unit can be held by said grooves 11 on the frames 10 in such a manner that the axis of the tube 30 becomes perpendicular to the sides of the frames 10, so that a holding unit provided with a holding member can freely travel along the endless groove.

Figure 12:
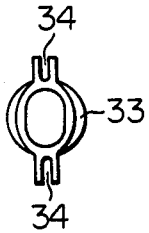
FIG. 12 is a front view of a support member.

The detailed construction of the holding member is shown in FIGS. 3 and 9 through 12. Referring to those figures, at the top of the suction tube 30, a support member 33 is fixedly mounted. The support member 33 is provided with two guide slits 34 arranged symmetrically as shown in FIG. 12. One of the bracket 44 is mounted at the back end and another at the middle of said suction tube, and between the two brackets 44 there is a back sliding member 37 mounted on the suction tube. In addition, between the two brackets 44 mounted at the middle of said suction tube and the support member 33 there is a front sliding member 36 mounted on the suction tube. A pair of finger pieces 31, 32 are pivotally mounted on both sides of the front sliding member 36, while the front part of said pieces are slidably engaged with the two guide slits 34 of the support member 33. At the back ends of each of said finger pieces 31 and 32, a stud 38 is mounted, and said studs 38 of both pieces are so arranged that they can be engaged in two curved grooves 42 provided on a circular plate 40, and also they can slide in horizontal guide grooves 39 provided on the back sliding member 37. These grooves 39 are arranged symmetrically and are perpendicular to the axis of the suction tube 30, so that by their relative displacement the front part of said pieces 31 and 32 can be projected laterally from the forward end of the support member 33, or retracted into the support member 33. The width between the outermost edges of the two finger pieces 31 and 32 is W′ when they are projected from the support member, and W when they are retracted into the support member. Preferably, as shown in FIGS. 9 through 11, the finger pieces 31 and 32 are so designed that their front edges and the front edge of the support member 33 are almost even when the finger pieces 31 and 32 are in their retracted or normal position. Therefore, both finger pieces 31 and 32 can be positioned with respect to the suction tube 30 as shown in FIG. 10. The state of the holding member shown in FIG. 10 is hereinafter referred to as the ready condition, and the state of the holding member shown in FIG. 11 is hereinafter referred to as the working condition.

Referring to FIG. 1, position I of the holding unit is called the starting position, position II is called the intermediate position, position III is called the stationary position, and position IV is called the drawn off position. In the method of the present invention, the travelling speed of a holding unit is low and constant from the time the holding unit starts from the position IV until it reaches position II, but from position II to position III its speed is faster. Preferably, for example, the faster speed is selected twice the lower speed. At the position III, the holding unit is held stationary for the same length of time as was required for the unit to travel from position I to II, for example three seconds. This stationary state is released by the movement of the following holding unit after side to side contact of the units. That is, the following holding unit exerts a pushing force upon contact. The pushed unit travels quickly along the endless passage by its own weight or assisted by some other positive driving means, so that it can reach position IV.

Figure 2:
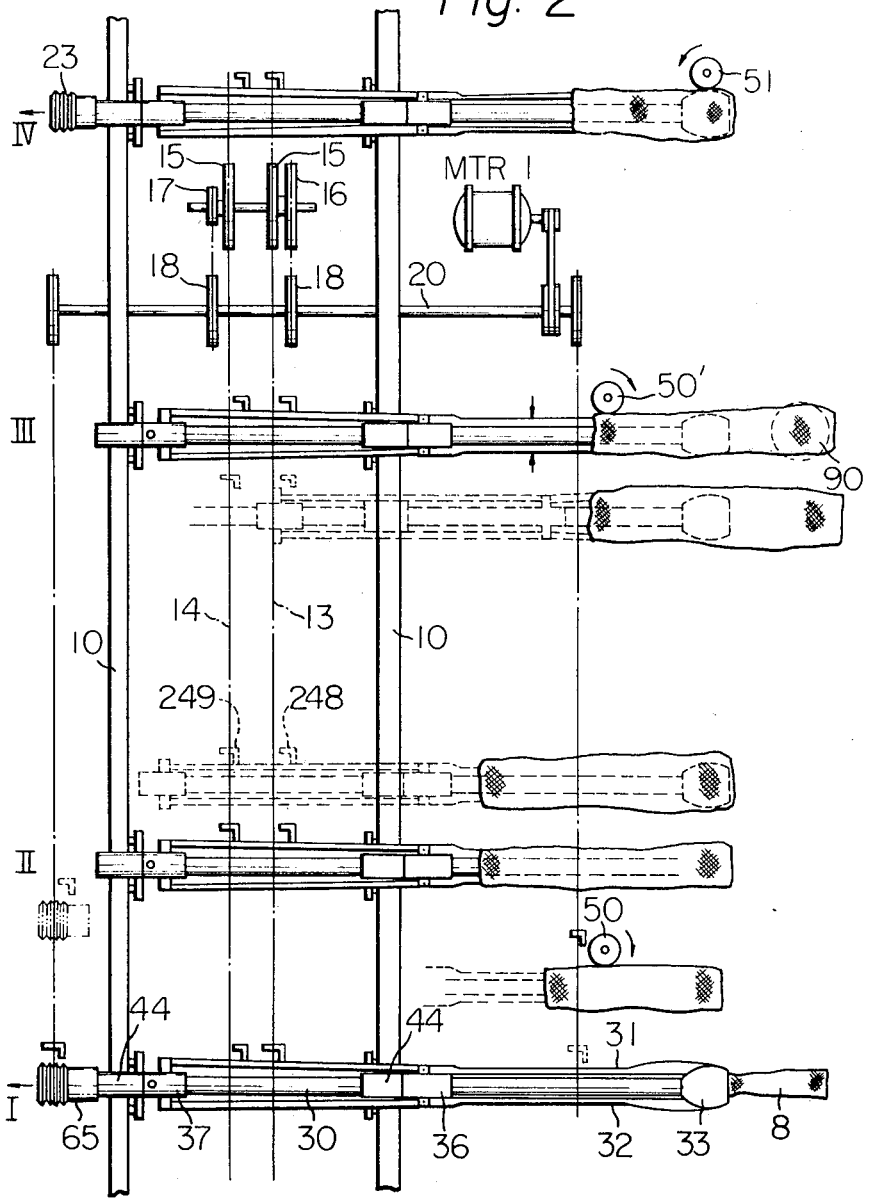
FIG. 2 is a developed and explanatory view showing each step within one cycle of the toe-closing operation of the present invention.

One embodiment to induce the above-mentioned movement of a holding unit is shown in FIG. 2. In FIG. 2 there is a low speed chain 13 and a high speed chain 14. Hooking member 248, 249 on a stay rod (not shown) are so arranged that one of them can engage the chain 13, and the other can engage the chain 14, but they are in such a relationship that when one of them is in action the other is idle. Between positions IV and II, the hooking member 248 is engaged with the chain 13, while the hooking member 249 is out of engagement with the chain 14 and between the positions II and III the hooking member 249 is engaged with the chain 14, while the hooking member 248 is out of engagement with the chain 13. Thus the traveling speed of the holding unit is low between positions IV and II, and high between positions II and III. When said holding unit reaches position III, the hooking member 249 and chain 14 are engaged, and said holding unit remains stationary at that position until it is pushed by the following holding unit. When said holding unit is moved out of position III, it can travel freely along the remaining endless passage by its own weight, and reach position IV. When said holding unit reaches position IV the engagement between the hooking member 248 and the chain 13 takes place.

Figure 4:
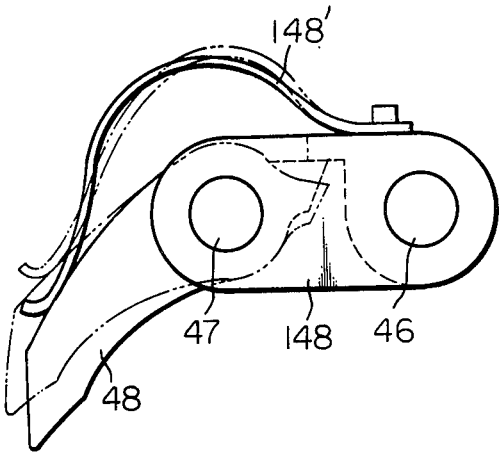
FIG. 4 is a detailed side view of a pawl for low speed.
Figure 15:
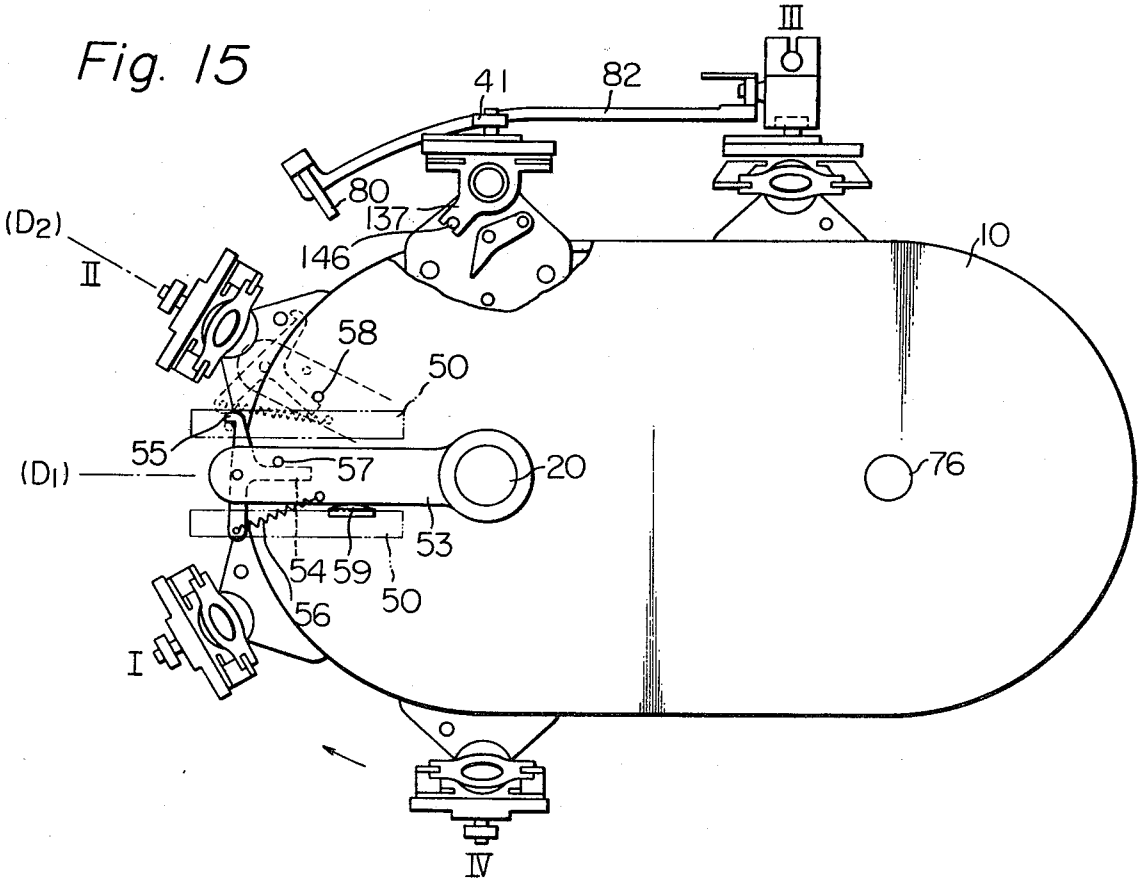
FIG. 15 is the front view of a synchronous angular tranversing apparatus for the drawing-on roller of the present invention.

An improved embodiment for traversing the holding unit is shown in FIGS. 3 through 8. As shown in FIG. 3, the supporting part of the holding unit for supporting a holding member, comprises a pair of brackets 44 with rollers 45, a stop pin 70 and three stay rods 46, 47 and 146, whereas, as shown in FIG. 10, said holding member consists of a suction tube 30 with a support member 33, front and back sliding members 36 and 37, and a pair of finger pieces 31 and 32. Said stay rods 46 and 47 fixedly support a follower 49 and a pawl unit, which consists of a pawl 48, a body of pawl 148 and the spring 148′ as shown in FIG. 4. Said stay rod 146 acts as a guide rod for maintaining said holding member in a horizontal condition, by engaging with the sliding fork 137 of the back sliding member to said stay rod 146 as shown in FIG. 15.

Figure 5:
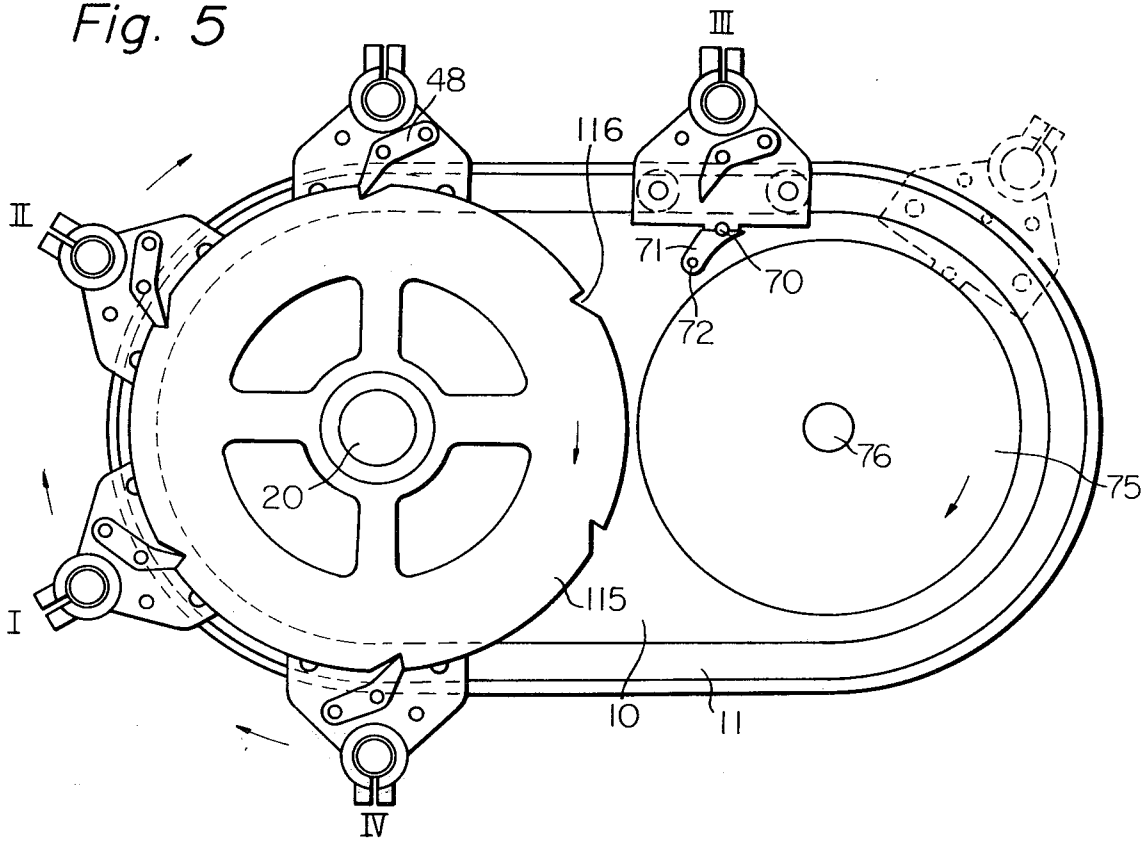
FIG. 5 is a sectional view of the arrangement of the loward frictional driving mechanisms for a holding unit.
Figure 6:
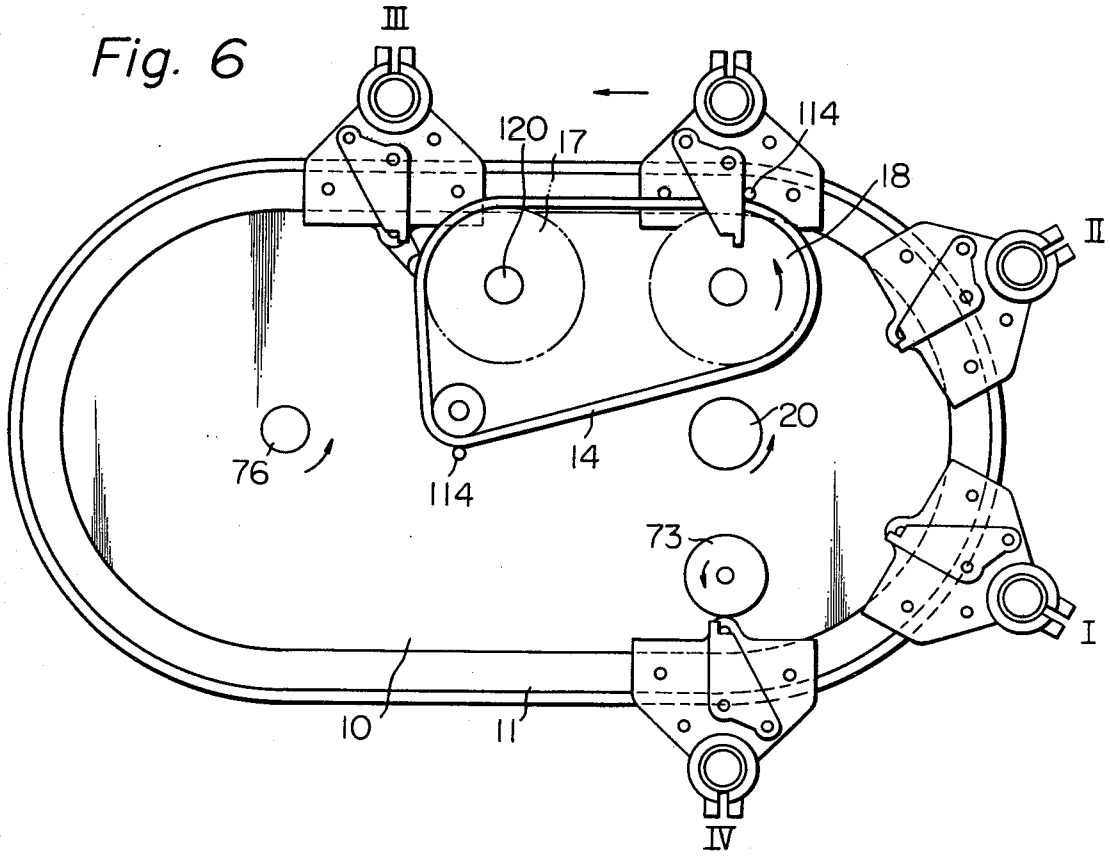
FIG. 6 is a similar sectional view to that of FIG. 5 but showing a high speed driving mechanism.
Figure 7:
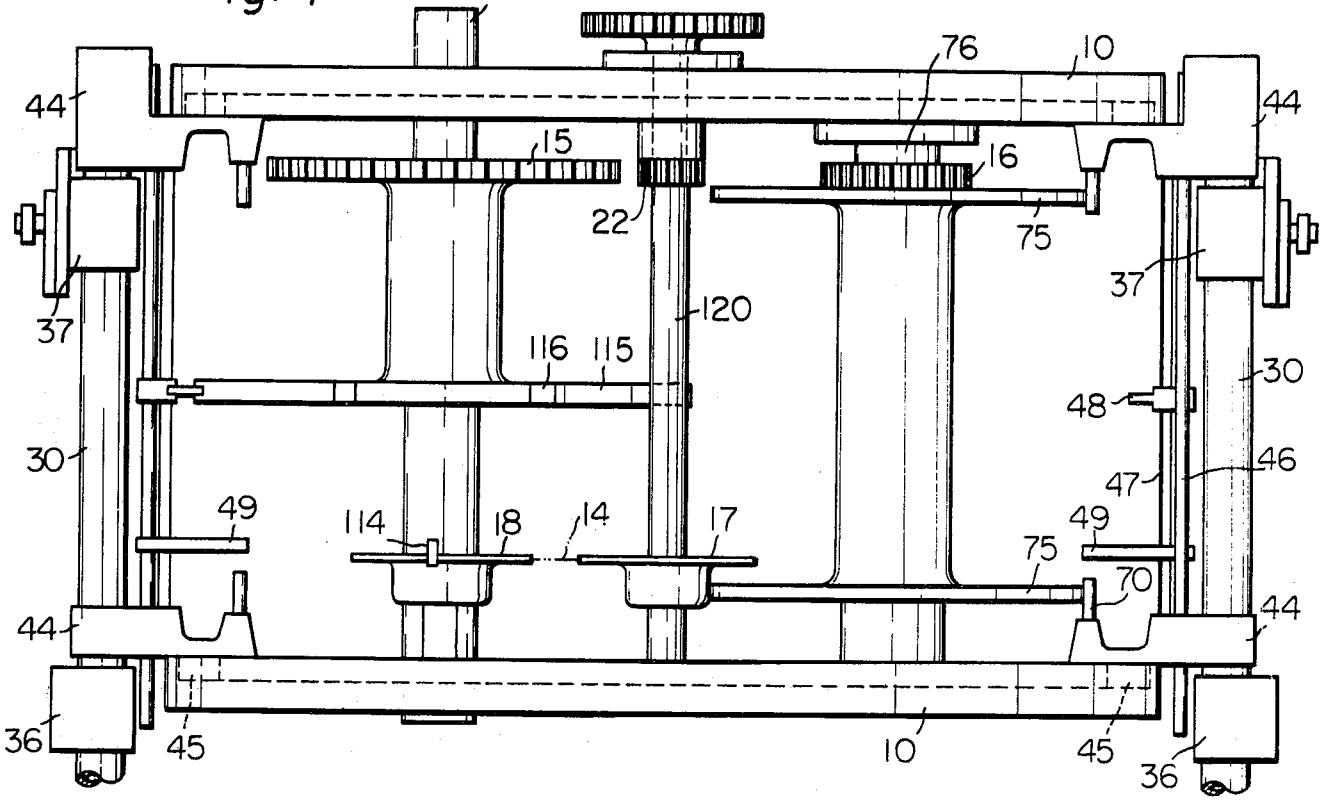
FIG. 7 is a plane view of the mechanism of FIGS. 5 and 6.
Figure 8:
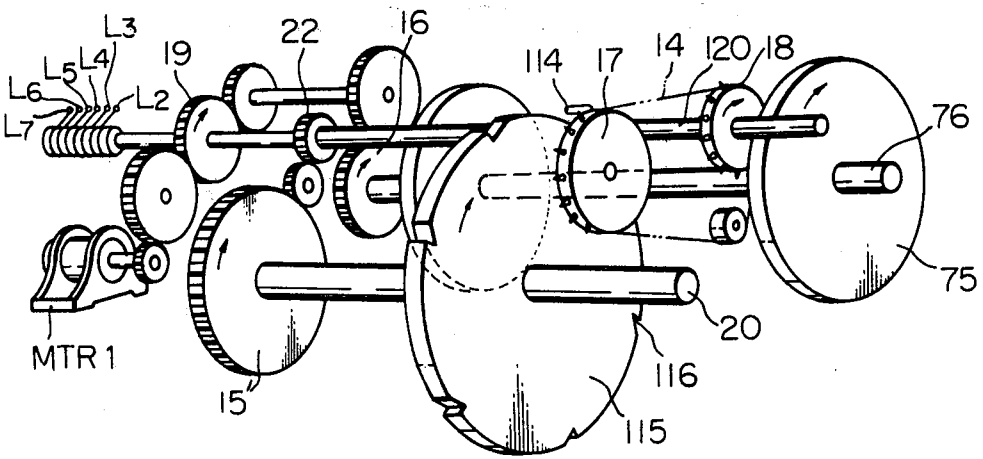
FIG. 8 is a perspective view of a driving gearing.

As shown in FIGS. 5 through 8, in the gearing arrangement of the improved embodiment, a driving disc 115 is used instead of the combination of the low speed chain 13 and chain wheel 17 in FIG. 2. The high speed chain 14 is also provided in this improved embodiment, but two projections 114, as shown in FIG. 8, are mounted on said chain 14. As can be seen in FIG. 5, a stopper lever 71 is pivotally mounted on a stud 72 fixed on the side of the frames 10, so that said holding unit, possessing inertial motion caused by being previously pushed by the high speed chain 14, can be stopped correctly at position III after said lever 71 engages a stop pin 70 provided on the bracket 44. In this embodiment, a friction drum 75 is employed, as shown in FIGS. 5, 7 and 8, the peripheral speed of said drum being three times the low traveling speed of said holding unit. Because of the frictional engagement of said drum 75 with the stop pin 70 on the bracket 44 and between positions III and IV the holding unit can reliably and quickly travel to position IV.

As shown in FIG. 6, underneath the shaft 20 the braking roller 73, which has a free running clutch mechanism, is mounted on each side frame 10 so that it can brake the movement of the supporting unit by engagement between the outer surface of said roller 73 and the surface of the stop pin 70 on the bracket 44 (shown in FIG. 3). Because this roller 73 can turn only in the counterclockwise direction, as shown in FIG. 6, due to its free running clutch mechanism, rebound of the supporting unit out of position IV, which would cause said roller to turn in the clockwise direction in FIG. 6 is prevented.

The gearing arrangement for turning the driving disc 115, includes chain wheel 17 and 18, and friction drum 75, as shown in FIG. 8. A main shaft 120 is turned by the motor MTR 1 via a gear train including a gear 19 mounted on said main shaft 120. A driving disc 115 is turned by the main shaft 120 via a gear train including a pinion 22 mounted on said shaft, a driving drum gear 15' on the shaft 20, onto which a driving disc 115 is mounted, and an idle wheel. The chain wheel 18 is mounted on the main shaft 120, and the gearing ratio between the pinion 22 and the gear 15' is so selected that, the traversing speed of the chain 14 driven by the chain well 18 is twice that of a holding unit whose movement induced by the driving disc 115 on the shaft 20. The friction drum gear 16 mounted on the friction drum shaft 76, on which a fricton drum 75 is also mounted, and said drum shaft, on which a friction drum 75 is also mounted, is turned by the main shaft via a gear train including a gear 19 mounted on the main shaft 120, a gear 16 mounted on said friction drum shaft 76 and two idle wheels mounted on a common idle shaft. From the gearing arrangement as mentioned above, the gearing ratio between the gear 16 and the gear 19 can be so selected that the traveling speed of the holding unit induced by the friction drum 75 is three times, the traveling speed of said holding unit induced by the driving disc 115. The engagements of the holding unit with the driving disc 115 and with the projection 114 on the chain 14, are made by the pawl 48 and the follower 49 respectively, both of which are fixedly mounted on the stay rods 46 and 47 of the supporting part as shown in FIG. 3, but the engagement of the holding unit with the friction drum 75 is made by the stop pin 70 mounted on the bracket 44.

Referring to FIGS. 10 and 11, the front and back sliding members 36 and 37, on which a pair of finger pieces 31 and 32 are mounted, are slidably mounted on the suction tube 30, so that said sliding members can be displaced along the longitudinal axis of said suction tube. Mounted on the top surface of the circular plate 40 is a projection 43 having a configuration as shown in FIGS. 10 and 11. Above the upper surface of said projection 43 a top roller 41 is mounted so that its axis coincides with that of the plate 40.

Figure 13:
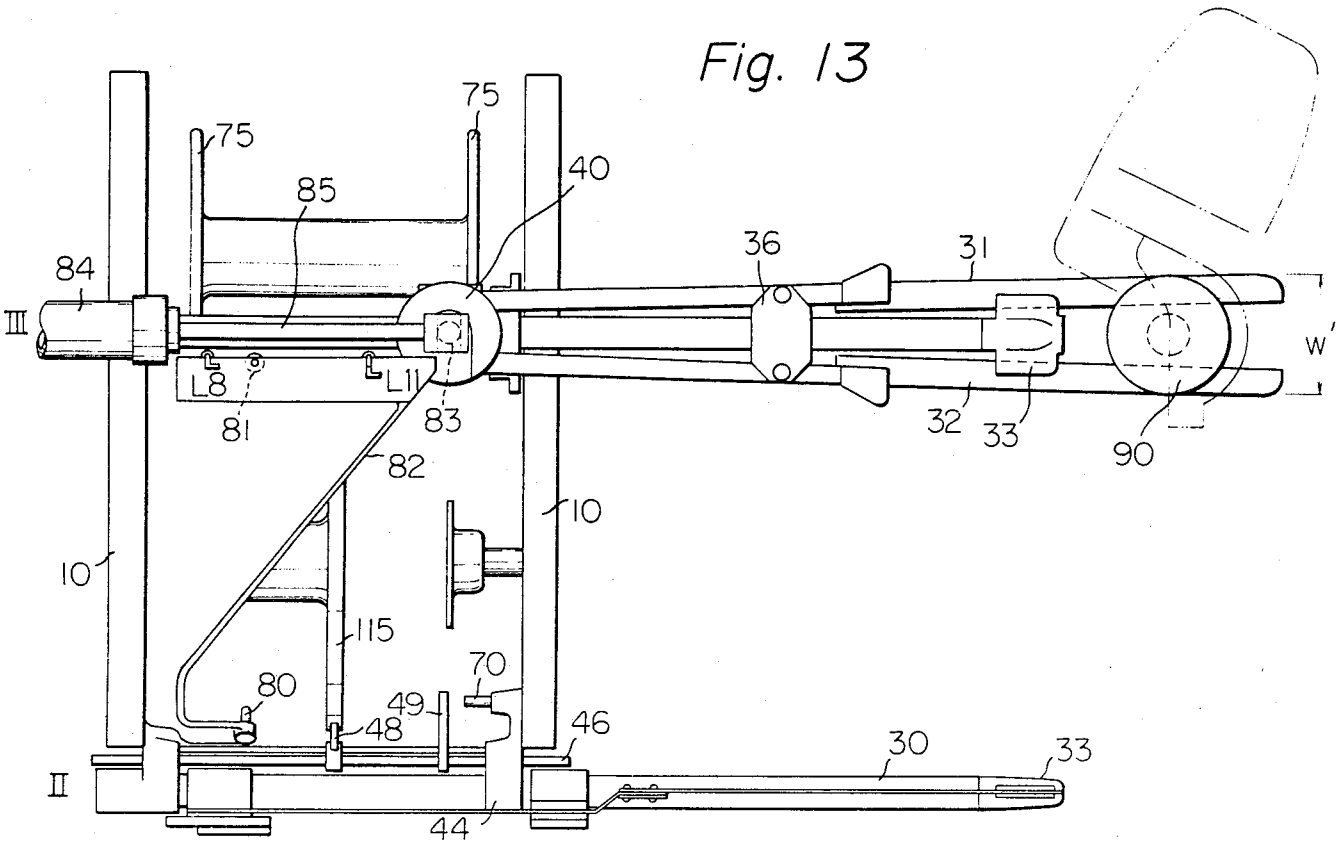
FIG. 13 is a plane view showing the relationships between the finger pieces which are spread out and the clamp member of the sewing machine.
Figure 14:
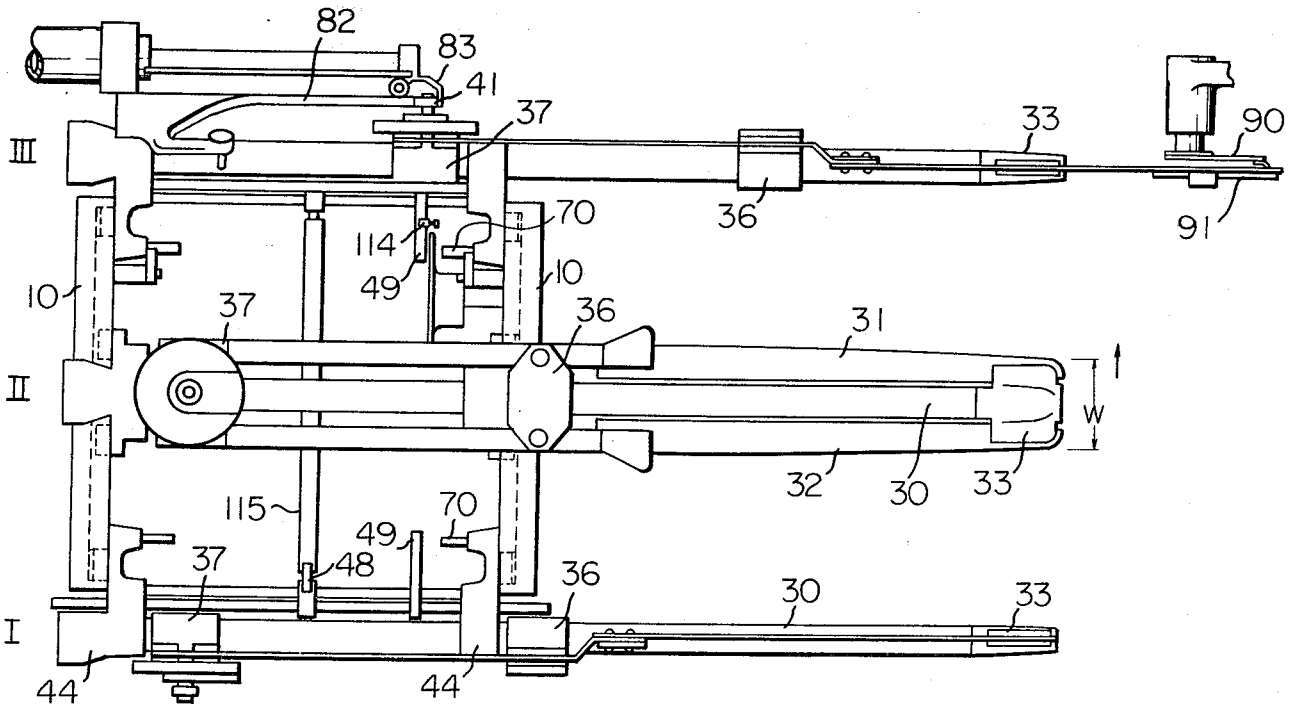
FIG. 14 is a side view showing the relationships between the finger pieces and the clamp member of the sewing machine as shown in FIG. 13.

Between the positions II and III, a forward cam plate 82 is provided on the side frame 10, as shown in FIGS. 13 through 15. Provided on the upstream edge of said plate 82 is a wider pin 80 which can contact one side of said projection 43 on the circular plate 40, while the cam surface of said plate 82 can contact the peripheral surface of the top roller 41. A return roller 81, which can contact the side of said projections 43 opposite to the side previously contacted by said wider pin 80, is mounted on said plate 82 at a midway point of the stroke of a piston rod. During the travel of the holding unit from the position II to the position III, if said wider pin 80 contacts the side of the projection 43 on the circular plate 40, the circular plate 40 is turned in the clockwise direction in FIG. 10, and moves to the orientation shown in FIG. 11. This means that the free ends of the pair of finger pieces 31 and 32 are spread laterally from the width of W to the width of W'.

If the top roller 41 is guided by the cam surface of the forward cam plate 82, the front and back sliding members 36 and 37 together with a pair of finger pieces 31 and 32 are displaced longitudinally along the axis of the suction tube 30, as shown in FIG. 13. As shown in FIGS. 13 through 15 at the position III, there is provided an air cylinder 84 with a piston rod 85, and on the top portion of said rod 85 a backward hook member 83 is mounted. Said hook member 83 is so constructed that it engages the outside of the top roller 41. When said piston rod 85 is retracted into the cylinder 84, the front and back sliding members 36 and 37 together with the finger pieces 31 and 32 are displaced along the suction tube 30 until the free end of the finger pieces comes into line with the outer surface of the support member 33.

The mechanism for inducing the angular movement of first drawing-on rollers 50 from position $D_1$ to position $D_2$, which movement is synchronous to the angular movement of a holding unit, is the same as the mechanism which moves the suction pipe 65 from position $C_1$ to position $C_2$.

Figures 18, 19:
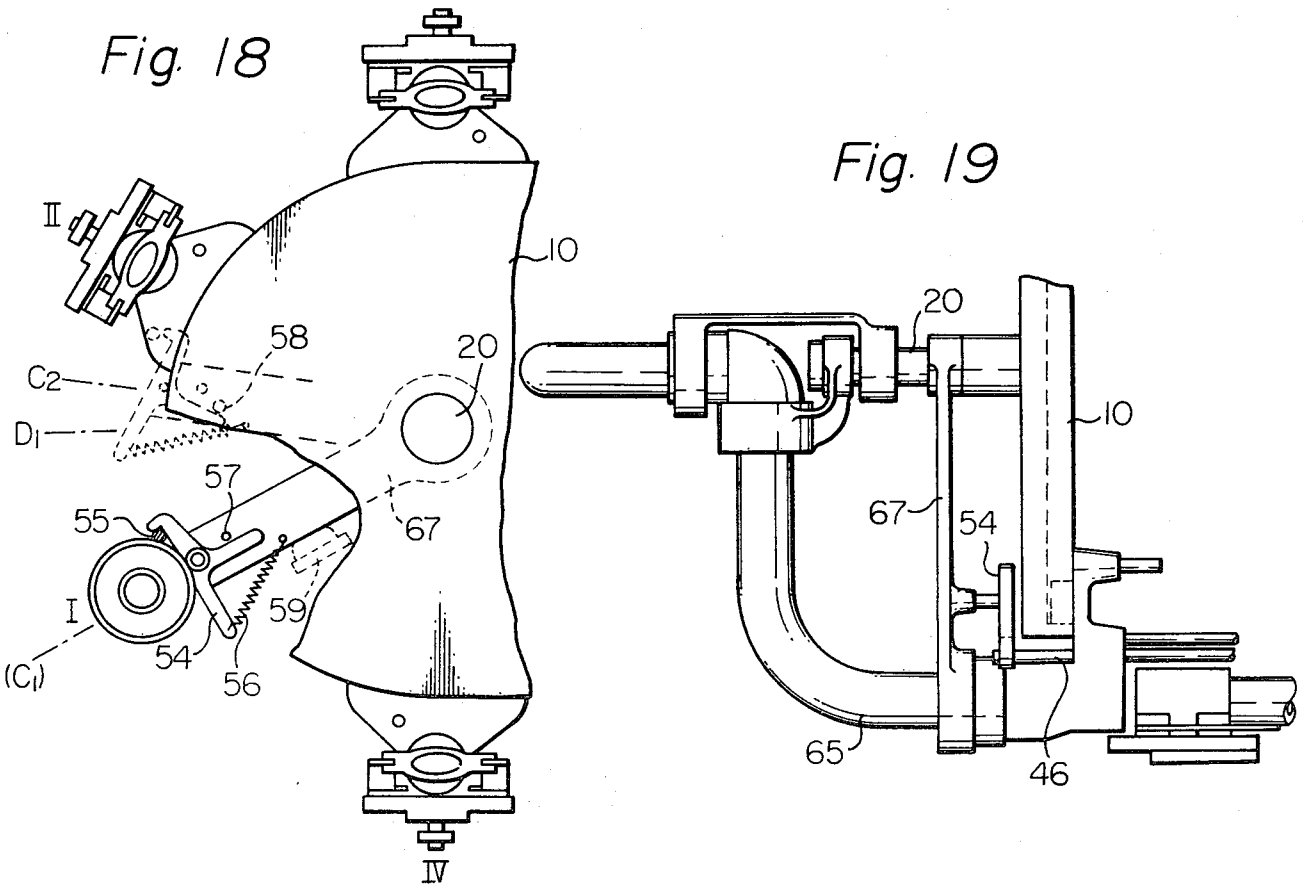
FIG. 18 is a front view of a synchronous angular traversing apparatus for a suction pipe.
FIG. 19 is a side view of the apparatus shown in FIG. 18.

Angular displacing arms 53 and 67 as shown in FIGS. 15 and 18, are rotatably mounted on the shaft 20 outside of the frames 10. At the top portion of each of said arms 53 and 67, T-shaped hook lever 54 is pivotably mounted by means of a pin. One end of the horizontal part of each of said T-shaped hook lever 54 is formed into a hook 55, while the other end of said horizontal part is engaged by the spring 56. A rest pin 57 is provided on each of said arms 53 and 67, so that the turning movement of said hook levers 54 by means of said spring 56 is stopped by these pins 57 when said pins 57 contact the side of the vertically extended portion of the arms 53 and 57. At the ready positions of said arms 53 and 67, which are in line with the position $D_1$, and the position $C_1$ in FIGS. 15 and 18, respectively, said arms are supported by the supporters 59. Preferably said position $C_1$ is the position I of the holding unit, while the position $C_2$ is somewhat higher than a horizontal plane passing through the center of shaft 20 in FIG. 18. The position $D_1$ is on said horizontal plane, while the position $D_2$ is the position II of the holding unit in FIG. 15. As both ends of the stay rod 46 are projected outside the outside surfaces of the two brackets, when the holding unit passes through the position $D_1$ at which the arm 53 (see FIG. 15) is stationary, said projected end of the stay rod 46 engages with the hook 55 of the hook lever 54, and after this engagement occurs the holding unit together with the arm 53 then moves angularly. Similarly, when the holding unit passes through the position $C_1$ at which the arm 67 is stationary, said projected end of the stary rod 46 engages with the hook 55 of the hook lever 54, and after this engagement occurs the holding unit together with the arm 67 moves angularly.

A releasing pin 58 is provided on the outside surface of both side frames 10, so that the engagement between the respective hooks 55 and the end of the stay rod 46 is released when the arm 53 arrives at the position $D_2$ or the arm 67 arrives at the position $C_2$. After this disengagement occurs, the arms 53 and 67 are moved downwardly by their own weight, or in some case by the assistance of a spring not shown, and finally stop at their ready positions of $D_1$ and $C_2$, respectively.

As shown in FIG. 2, there are three kinds of rollers for drawing-on or drawing-off hose 8 on the suction tube 30. One of these kinds of rollers, is a first drawing-on roller 50, as shown in detail in FIGS. 16 and 17. There are two of these rollers 50 and both are supported by the swing arm 52 pivotally mounted on the body of the angular displacing arm 53. Both of these rollers 50 are arranged on one shaft 98 positioned directly below the finger pieces 31 and 32. The shaft 98 is rotatably supported on the end of one arm of said swing arm 52, while on the other arm of said swing arm 52 a motor MTR 4 is mounted. The rotations of said first drawing-on roller 50 are transmitted from the motor MTR 4 by means of a motor pulley 96 and a follower pulley 97 via a chain.

Onto the outer end of the extended boss of the angular displacing arm 53 a stepped portion 153 and a shaft 154 are provided. A sliding block 61 is slidably mounted on both the stepped portion 153 and the shaft 154. At the outer end of said shaft 154 a piston 155 is fixedly mounted. At one end of said sliding block 61 an inner cylinder surface, within which said piston 155 moves, is provided so that a cavity 62 is defined by said surface and the piston 155, while at the opposite end of said sliding block 61 a cylindrical cavity 156, within which a spring 63 is housed, is formed. By the arrangement of the spring 63 between the outer end of said stepped portion 153 of the boss of the angular displacing arm 53 and the upper surface of said cylindrical cavity 156, the sliding block 61 is moved so that the sliding block 61 is separated from the root of said stepped portion 153. When compressed air is inserted into the cylinder area after passing through an inlet hole (not shown) provided on the piston 155, said compressed air acts to push back said sliding block 61 against the spring force of the spring 63, so that said sliding block 61 comes into contact with the root of the stepped portion 153 of the boss of the angular displacing arm 53, as shown in FIG. 16.

Figure 16:
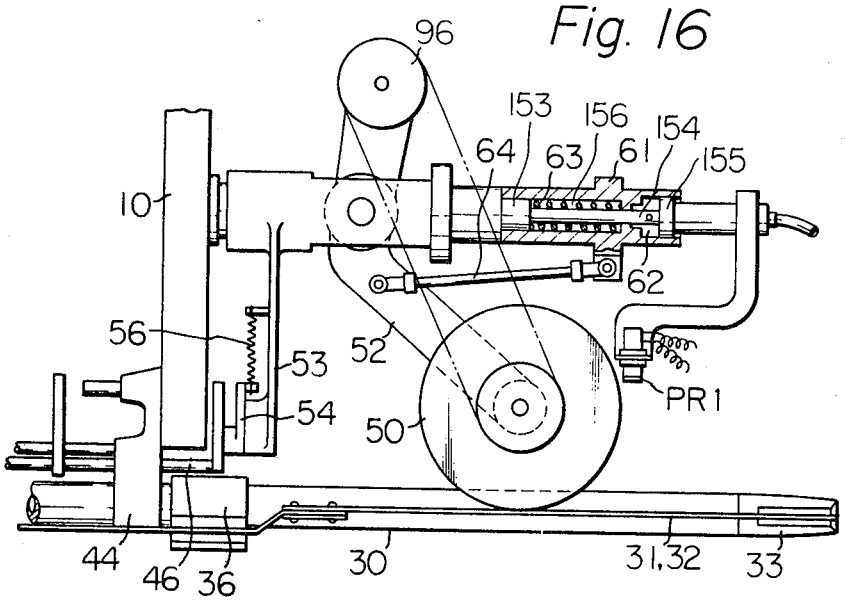
FIG. 16 is a side view of the drawing-on roller when it is in operation.
Figure 17:
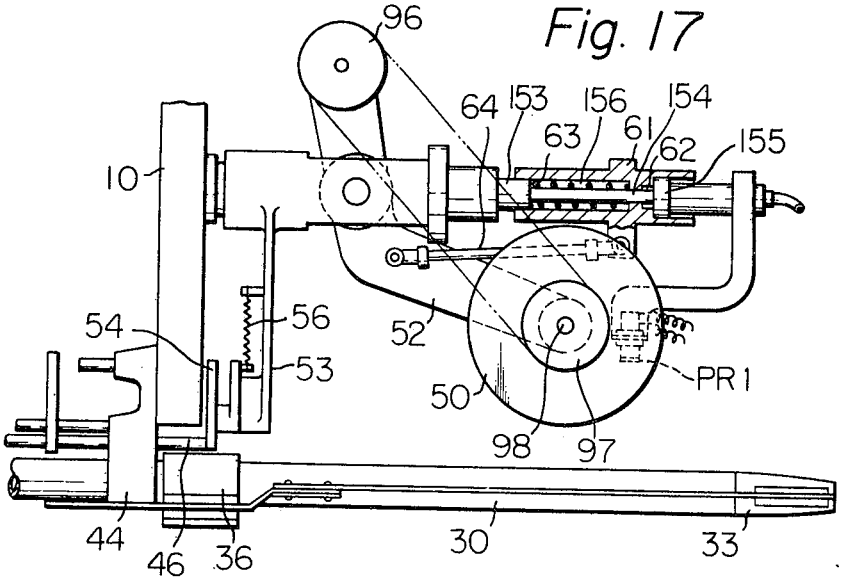
FIG. 17 is a view similar to that of FIG. 16, but when the drawing-on roller is not in operation.

Referring to FIGS. 16 and 17, a rod 64 is arranged between the arm of the swing arm 52 and the projection of the sliding block 61, and the two ends of said rod 64 are pivotally mounted by pins on the swing arm 52 and the block 61. By this arrangement, when the sliding block 61 is pushed back by the compressed air the first drawing-on rollers 50 are moved downwardly in the drawing, so that the surfaces of said rollers 50 come into contact with the upper surfaces of the finger pieces 31 and 32 respectively. When the sliding block 61 is pushed by the spring 63, the first drawing-on rollers 50 are lifted so that the first drawing-on rollers 50 are freed from contact with the surface of the finger pieces 31 and 32. In some case, a photoelectric inspector PR1 mounted on said piston 155 is provided, so that it can detect the existence of hose 8 on the suction tube 30 and the finger pieces 31 and 32. The operation of the PRI is described later in this specification.

Figure 20:
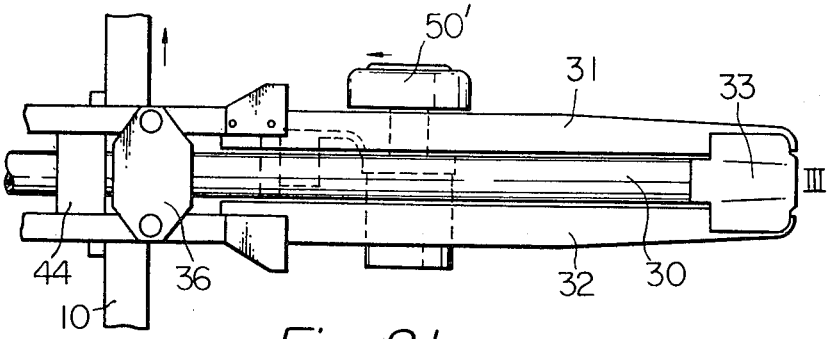
FIG. 20 is a plane view of the winding-on mechanism after the toe-closing operation.
Figure 21:
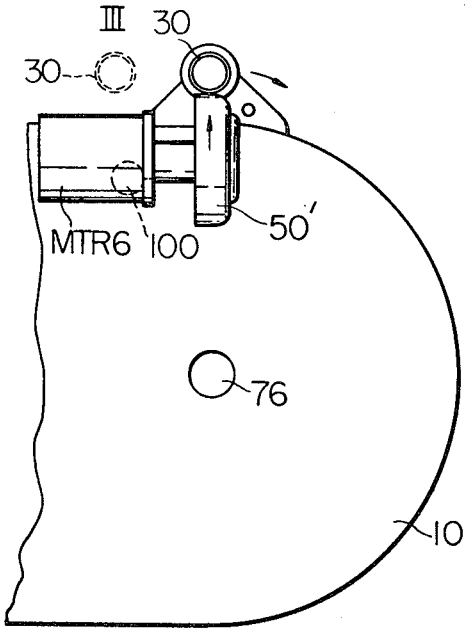
FIG. 21 is a front view of the apparatus shown in FIG. 20.

As shown in FIGS. 20 and 21, the second drawing-on roller 50' is arranged slightly downstream from position III, so that it can contact the surface of the suction tube 30 approximately midway between the front sliding member 36 and the support member 33. This roller 50' is driven directly by the motor MTR6, and the roller 50' and motor MTR6 are swingably supported by a supporting pin 100 fixed on the side frame 10. A helical torsion spring (not shown) arranged coaxial with said pin 100 causes the roller 50' and motor MTR6 to turn on the pin 100 so that the roller 50' moves towards and comes into contact with the surface of the suction tube 30 and the finger pieces 31 and 32 which are covered by the welt portion of the already toe-closed hose 8. This contact relation is continued from the time the holding unit is moved by the following holding unit until the holding unit is moved at higher speed by the action of the friction drum.

Figure 22:
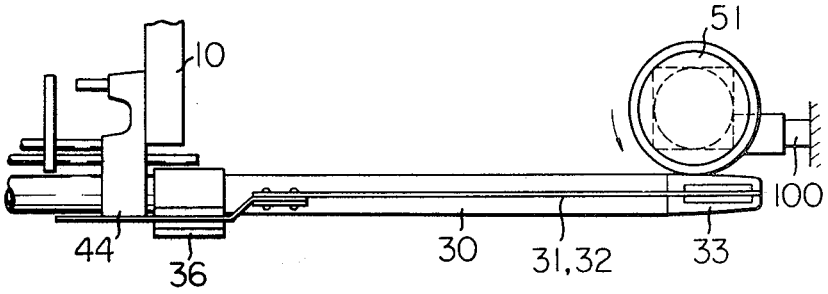
FIG. 22 is a side view of the drawing-off mechanism after the toe-closing operation.
Figure 23:
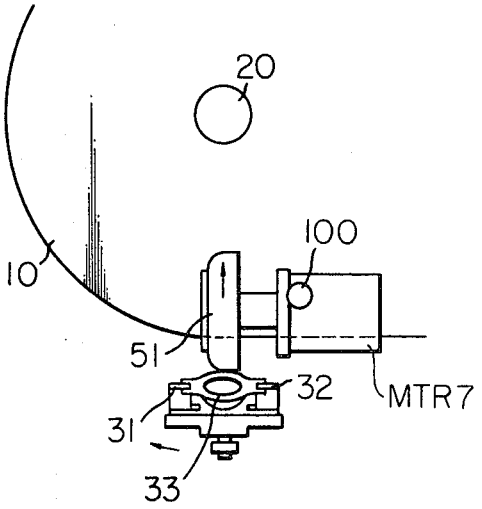
FIG. 23 is a plane view of the apparatus shown in FIG. 22.

The drawing-off roller 51 shown in FIGS. 22 and 23, is directly driven by the motor MTR7, and the construction and movement of the roller 51 and motor MTR7 are similar to those of the above-mentioned second drawing-on roller 50' and motor MTR6. However, the drawing-off roller 51 is arranged at the position where its surface can come into contact with the upper surface of the support member 33, and this contact relation is continued until the holding unit is moved by the driving disc 115 shown in FIG. 8. This occurs at position IV, where the suction tube 30 is then connected to the aperture of the pneumatic transferring duct 23, as shown in FIG. 1, so that the seamless hose 8 can be transported to the downstream working station by a suction air stream in the duct 23.

The toe-closing operation by means of the method of the present invention can be carried out by the following steps.

First Step

Referring to FIG. 2, when a holding unit passes position I, the operator picks up the welt portion of a seamless hose 8, and holds its toe end in front of the suction tube 30 of the holding unit. Then a suction force is applied into the suction tube 30 by actuating a pneumatic system whereby the seamless hose is sucked into the suction tube 30, toe end first, while the operator holds the welt end portion of the hose 8. This operation is carried out during the displacement of the holding unit from the position I, which is also $C_1$ to position $C_2$ shown in FIG. 18. During this operation, the suction tube 30 remains connected to the suction pipe 65, because said suction tube 30 moves synchronously with the displacement of the holding unit. Consequently, suction force is applied into the suction tube 30 when the suction system is actuated.

After the holding unit reaches the position $C_2$, the suction tube 30 is disconnected from the suction pipe 65 and then said suction pipe 65 is returned to its position $C_1$. The suction force in the suction tube 30 is, of course, released when the suction tube 30 is disconnected from the suction pipe 65. Then the operator places the welt portion of the hose 8 over the free end portion of the support member 33 of the holding unit in such a way that the welt portion partly covers the outer ends of the finger pieces 31 and 32, and the support member 33 of the suction tube 30. Just after completion of this manual operation, the first drawing-on rollers 50 are mechanically lifted so that they approach and contact the underside surface of the finger pieces 31 and 32, covered by the welt portion of the hose 8, and said hose is drawn out of the aperture of the suction tube 30 and onto the outside of said tube 30 and the finger pieces 31 and 32 by the rotation of said rollers 50. According to the above-mentioned operation, the hose 8 is turned inside-out. While the hose 8 is being drawn onto the suction tube 30 and the finger pieces 31 and 32, the rollers 50 are displaced from the position $D_1$ to the position $D_2$, shown in FIG. 15, synchronously with the displacement of the holding unit from the position I to the position II.

Just before completion of the above-mentioned drawing-on operation, said rollers 50 are freed from the finger pieces 31 and 32 and positioned as shown in FIG. 17. When the rollers 50 reach position $D_2$, said roller 50 are returned to the position $D_1$.

Second Step

During the movement of the holding unit from the position II to a position midway between position II and position III, the projection 43 of the circular plate 40 of the holding unit is turned toward the clockwise direction in FIG. 11 by the operation of the wider pin 80. As a result, the free ends of the finger pieces 31 and 32 are spread laterally from the width of W to the width of W'. When the spreading out of the finger pieces is completed, the finger pieces 31 and 32 are projected beyond the free forward end of the support member 33. Such displacement of the finger pieces 31 and 32 along the longitudinal axis of the suction tube 30 takes place by the traversing movement of the holding unit due to the contacting of the top roller 41 of the back sliding member 37 with the cam surface of the forward cam plate 82. During the above-mentioned operation, the position of the toe portion of the hose 8 on the finger pieces 31 and 32 can be maintained stably because of the lateral spreading out motion of the finger pieces 31 and 32. Consequently, the toe end portion of the hose 8 remains in a flatly spread out condition, as shown in position III in FIG. 2.

During the movement of the holding unit from said position midway between the positions II and III to the position III, the holding unit is moved at twice the speed that it traveled before and the finger pieces 31 and 32 are further displaced along the longitudinal axis of the suction tube 30 until they reach the position shown in position III in the FIGS. 13 and 14. In the region near the position III, the holding unit is moved only by the force of the push it previously received from the chain 14. Stopper levers 71 as shown in FIG. 5 are provided on both side frames 10, so that when the recess on the stopper lever 71 comes into engagement with the stop pin 70 on the bracket 44, the movement of the holding unit can stop with the holding unit stopping correctly at the position III.

Third Step

This step is similar to the conventional toe closer.

Referring to FIGS. 13 and 14, at the same time, or after a time delay of 0.1 second, the traversing of the holding unit is stopped and the upper clamp 90 (or presser foot) of the sewing machine is lowered toward the lower clamp 91 (or table surface) by means of a rotary solenoid not shown in drawings. Consequently, the toe end portion of the hose 8 together with the free ends of the finger pieces 31 and 32, which are inserted between the upper and lower clamps 90 and 91, are gripped by said clamps. As soon as this gripping of the toe end portion of the hose 8 by means of said upper and lower clamps 90 and 91 takes place, an air cylinder 84 is actuated so as to retract the piston rod 85 whereby backward hook member 83 on the piston rod 85 pulls the top roller 41 mounted on the back sliding member 37 toward the air cylinder 84. Consequently, the finger pieces 31 and 32 are retracted from the clamp of the upper and lower clamps 90 and 91, while the toe end of the hose 8 is held by said clamps. In this condition, the welt portion of the hose 8 is still held by said upper and lower clamps 90 and 91 as shown in position III in FIG. 2. During the pulling of the top roller 41 by the piston rod 85 the projection 43 on the circular plate 40 is turned toward the counterclockwise direction in FIG. 10 by the stationary return roller 81 mounted on the forward cam plate 82 as shown in FIG. 13, so that the laterally spread out finger-pieces 31 and 32 return to their retracted condition as shown in FIG. 10.

Fourth Step

This step is also similar to the conventional toe closer.

Upon the return of the finger pieces 31 and 32 to their normal position on the suction tube 30, the clamp 90 is turned by means of a rotary solenoid not shown in drawings. At the same time, the toe end portion of the hose 8 is stitched and closed with the sewing thread and cutting out the waste hose by the cutter on the sewing machine.

After completion of the above-mentioned sewing operation, the upper clamp 90 is displaced upward by the solenoid and separated from the bottom clamp 91, and the closed toe end portion of the hose 8 hangs from the forward free end of the support member 33 is relaxed condition. The holding unit remains stationary at the position III for a short time, for example 3 seconds.

Fifth Step

After the lapse of the above-mentioned short time from the moment the holding unit reaches position III, said holding unit is pushed out of position III by the traversing movement of the following holding unit. By the drawn-on action of the second drawing-on roller 50', which is approached and contact the lower surface of the suction tube 30 covered by the welt portion of the seamless hose 8, the hose 8 on the suction tube 30 is further drawn-on the suction tube 30. This operation is continued as long as the holding unit passes over the second drawing-on roller 50'. By the rotation of the roller 50', the hanging portion of the hose 8 is drawn onto the outside of the suction tube 30 and the finger pieces 31 and 32. Just after the completion of this drawing-on operation by the roller 50', said holding unit is moved at a higher speed than before by the rotating friction of the fricton drums 75, as shown in FIGS. 5 and 13, because the outer surfaces of said friction drums 75 come into frictional contact with the stop pins on the bracket.

Sixth Step

One way braking rollers 73 are mounted on both side frames 10 at the position IV, so that they act to brake and to stop the arriving holding unit at the position IV exactly. When the holding unit arrives at position IV, the suction tube 30 is connected to the aperture of the pneumatic transferring duct 23 immediately, and seamless hose 8 is turned outside-out by the suction force in the suction tube 30 and the rotation of the roller 50′ on the surface of the support member 33. That is, as the hose 8 is sucked into the suction tube 30 it is turned outside out. After being sucked into the suction tube 30 in the outside-out condition by the actions of the roller 50′ and the suction force, the hose 8 is transported to the downstream working station by a suction air stream in the duct 23.

When the pawl 48, as shown in FIG. 4, mounted on said holding unit comes into engagement with the notch 116 of the driving disc 115, shown in FIG. 5, said holding unit begins to travel toward position I.

Figure 24:
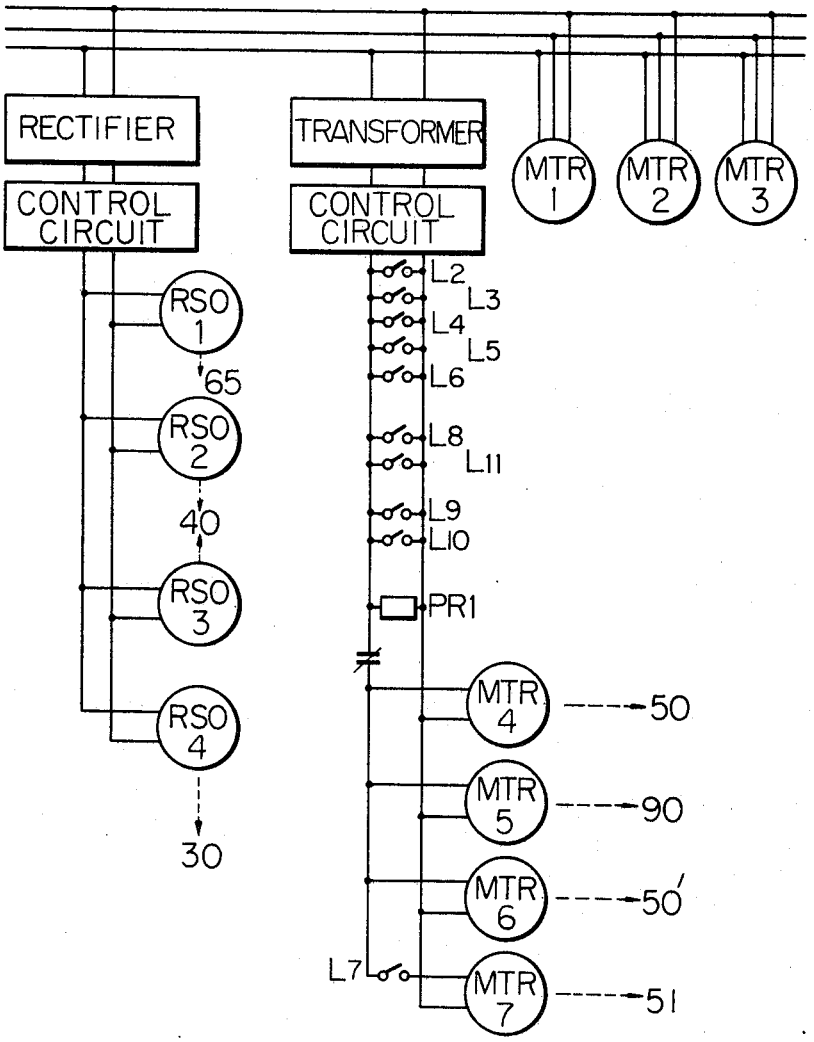
FIG. 24 is a wiring diagram for controlling the operations of the toe-closer.

Referring to FIG. 24, a main motor MTR1 for driving the toe closer, a motor MTR2 for the sewing machine, and a motor MTR3 for a suction blower are connected in parallel to a three phase electrical source. A rectifier for a rotary solenoid circuit and a transformer for control circuit are connected in parallel to two of said three phases. From said rectifier, via a control circuit, the following are connected in parallel; a rotary solenoid RSO1 for closing a damper for the suction pipe 65 as shown in FIG. 19; a rotary solenoid RSO2, for lowering the clamp 90 of the sewing machine; a rotary solenoid RSO3, for turning said clamp 90 of the sewing machine and; a rotary solenoid RSO4, for the damper situated at the position of the hose to be drawn off, and controlled by a switch L7, which is acutated by the control drum. From the transformer, via a control circuit, the following are connected in parallel; a switch L2, for detecting the completion of the lifting movement of the clamp 90; a switch L3, which is arranged in series to the switch L8, for detecting when the finger pieces 31 and 32 are in their retracted condition; a switch L4, for initiating the lifting movement of the first drawing-on roller 50; a switch L5, for initiating the lowering movement of the clamp 90, and; a switch L6, for indicating the initiation of the retracting movement of the piston rod 85. All of the above switches and the switch L7 are acutated by the rotating control drum. In addition, a switch L8 for detecting the retracting length of the piston rod 85, and a switch L11 operated by the piston rod 85 for detecting the completion of the movement of the finger pieces 31 and 32 away from the clamp 90, are mounted on the forward cam plate 82 and are also connected in parallel through the control circuit to the transformer. Furthermore, a switch L9 for detecting a hose 8 being clamped by the clamp 90, and a swtich L10 for detecting the completion of the toe-closing operation for a hose are arranged on the sewing machine, and are also connected in parallel through the control circuit to the transformer.

When the holding unit reaches the position $C_2$ as shown in FIG. 18, the switch L4 is pushed by the control drum, and it acts to operate the rotary solenoid RSO1 so that air flow passing through the suction pipe 65 can be shut off. The winding-on rollers are then lifted toward and come into contact with the finger pieces, after compressed air is supplied into the cavity 62 as shown in FIG. 16, so that the hose can be turned inside out. By means of a timer not shown, after a lapse of about two seconds from the time the air is supplied into the cavity 62, the feeding of the compressed air is cut off from the cavity 62 and the first drawing-on rollers 50 are lowered by means of the spring 63 so that they are no longer in contact with the surface of the finger pieces 31 and 32. The use of the photoelectrical detecting apparatus PR1 as shown in FIGS. 16 and 17 is optional. This apparatus detects the existence of the hose 8 on the finger pieces 31 and 32 at any given moment. If no hose is there, then the apparatus PR1 acts to prevent the lifting movement of the first drawing-on rollers 50.

When the movement of the holding unit with hose 8 is stopped by the stopper lever 71, the upper clamp 90 immediately or after a time delay of 0.1 second, starts to move downwardly due to the action of the rotary solenoid RSO2 via the switch L5 actuated by the control drum. After the clamp 90 is completely lowered the retracting movement of the piston rod 85 is initiated via the switch L6 actuated by the control drum. When the switch L11 on the cam plate 82 is actuated by the hook member 83 on the piston rod 85 due to the retracting movement of said piston rod, the toe-closing is started by the sewing machine according to the conventional toe-closing sequence. Only when the switch L8 on the cam plate 82 is actuated by retracting movement of the piston rod 85, is said switch allowed to continue the operation of machine. This safety circuit consists of a series arranagement of the switch L8 and the switch L3, which are actuated by the control drum, and therefore, if either of the above-mentioned switches are not actuated the machine is stopped immediately.

When the switch L10 is pushed by a cam of the sewing machine, not shown, which indicates that the toe-closing operation is over, the clamp 90 is lifted and returned to its original stand-by position by a spring, not shown, and when the action of the rotary solenoid RSO2 is released the motor MTR is stopped. The switch L2 for detecting the lifting of the clamp 90 is provided for the sewing machine so that if such lifting is not enough the machine is stopped immediately.

What is claimed is:

1. An apparatus for automatically closing the toe of seamless hose, comprising:

- a pair of side frames each provided with endless guide grooves;
- a plurality of holding members which consist of a suction tube, a pair of front and back sliding members and a pair of finger pieces;
- a pair of supporting parts each consisting of a bracket provided with rollers which engage in the endless grooves of the side frames, stop pins, stay rods on which a pawl for low speed and a follower for high speed are mounted;
- a driving disc with a plurality of notches for driving a plurality of holding units, which consist of a holding member and a supporting part, so that said units can be moved simultaneously at their low speed;
- a high speed driving means for driving a holding unit at high speed;
- a stopper for stopping said holding unit travelling at a high speed at a toe-closing position, which position is in line with the clamp of the stationary sewing machine;

first drawing-on rollers, which approach the surfaces of the pair of finger pieces and also which angularly displace synchronously with an angular movement of a holding unit;

a second drawing-on roller, which draws on hose already toe-closed onto a pair of finger pieces;

a drawing-off roller, which turns said hose inside-out, and;

a suction means for transporting said base already toe-closed to successive working stations.

2. An apparatus as claimed in claim 1, further comprising:

a friction drum for driving a holding unit, provided with toe-closed hose, from the toe-closing position to the draw-off position at a speed faster than its low and high travelling speeds.

3. An apparatus as claimed in claim 2, further comprising, a one way braking roller, which acts to prevent the rebound of a holding unit from a draw-off position at which position said hose is transported to the successive working station.

4. An apparatus as claimed in claim 1, wherein said holding member comprises:

a suction tube provided with a support member at its outermost end;

a front sliding member, which slides along the longitudinal axis of said suction tube;

a back sliding member provided with a pair of guide grooves, on which member a turnable circular plate with curved guide grooves is mounted;

a pair of finger pieces, one end of each finger piece being provided with a stud which engages with any of the guide grooves of the back sliding member and also any of the curved guide grooves of the turnable circular plate, and the other end of each finger piece engaging with any of the guide slits of the support member so that said end slides outwardly or retracts into said guide slit, while the center of said finger piece is pivotally mounted on said front sliding member.

5. An apparatus as claimed in claim 4, further comprising:

said turnable circular plate provided with a projection, and a top roller rotatably mounted at its center, and;

a forward cam plate mounted on the frame and also provided with a wider pin and a return roller which acts to turn the turnable circular plate.

6. An apparatus as claimed in claim 1, further comprising:

a photoelectrical detecting apparatus which detects the existence of the hose on the holding unit, and which acts to stop the lifting of the first drawing-on roller when said hose is not on said holding unit.

7. An apparatus for automatically closing the toe of seamless hose comprising:

a plurality of parallel holding units, each said holding unit including a suction tube for receiving a toe portion of a hose and a pair of finger pieces mounted adjacent said suction tube;

means for moving said holding units in an endless path with said suction tubes disposed perpendicularly of said path;

means for spreading a welt portion of a hose having a toe portion in a suction tube of one of said holding units over said suction tube while pulling the toe portion out of said suction tube and over said finger pieces;

means for moving said finger pieces of a holding unit relative to the suction tube thereof to flatten a toe portion of a hose located thereover while carrying the toe portion away from said suction tube;

a sewing machine mounted outside said endless path and having a clamp for receiving and clamping a toe portion of a hose carried on the extended finger pieces of a holding unit and means for sewing the toe portion closed; and a pneumatic system connected to the suction tubes of said holding units to selectively apply a suction force to each of said tubes to suck a hose having a closed toe portion into said suction tube.

8. An apparatus as set forth in claim 7 which further comprises a drawing off mechanism for withdrawing a hose disposed over a holding unit from said holding unit downstream of said sewing machine.

9. An apparatus for automatically closing the toe of seamless hose comprising:

a plurality of parallel holding units, each said holding unit including a suction tube for receiving a toe portion of a hose and a pair of finger pieces mounted adjacent said suction tube;

a pair of end frames having said holding units mounted thereon for movement in an endless path with said suction tubes disposed perpendicularly of said path;

a pneumatic system having a suction pipe selectively connected to a suction tube of one of said holding units positioned in a first position of said endless path for sucking a toe portion of a hose into said suction tube;

means mounted on one of said end frames at a second position of said endless path downstream of said first position for drawing a hose sucked into a suction tube of a holding unit out of and over said suction tube at said second position;

means for moving said finger pieces of a holding unit laterally and forwardly of said suction tube thereof during movement of the holding unit from said second position to a third position downstream thereof in said path to flatten a toe portion on said finger pieces;

a sewing machine mounted at said third position for closing the toe portion of a hose disposed on a holding unit at said third position;

means mounted on one of said end frames at said third position for retracting said finger pieces of a holding unit toward the suction tube thereof at said third position;

means mounted on one of said end frames at said third position for drawing a closed hose onto the suction tube of a holding unit thereat; and a pneumatic transfer duct at a fourth position of said path for selectively communicating with a suction tube of a holding unit thereat to suck a closed hose through said suction tube and into said duct.

* * * * *

UNITED STATES PATENT AND TRADEMARK OFFICE

CERTIFICATE OF CORRECTION

PATENT NO. : 3,952,673

DATED : April 27, 1976

INVENTOR(S) : Yoshinobu Fukuyama

It is certified that error appears in the above-identified patent and that said Letters Patent are hereby corrected as shown below:

Column 2, line 26 - Correct spelling of "beyond"

Column 4, line 67 - Correct spelling of "traversing"

Column 7, line 21 - Delete "and"

Column 7, line 43 - Between "said" and "shaft" insert --main--

Column 7, line 49 - Change "well" to --wheel--

Column 9, line 15 - Correct spelling of "stay"

Column 9, line 27 - Change "$C_2$" to --$C_1$--

Column 15, line 11 - Change "base" to --hose--

Signed and Sealed this

Twentieth Day of July 1976

[SEAL]

*Attest:*

RUTH C. MASON
*Attesting Officer*

C. MARSHALL DANN
*Commissioner of Patents and Trademarks*